US007350528B2

(12) United States Patent
Brunswick

(10) Patent No.: US 7,350,528 B2
(45) Date of Patent: Apr. 1, 2008

(54) WAREWASH MACHINE WITH MOVEABLE TABLE AND MULTI-POSITION RACK SUPPORT TRACK

(75) Inventor: Brian A. Brunswick, Tipp City, OH (US)

(73) Assignee: Premark FEG L.L.C., Wilmington, DE (US)

( * ) Notice: Subject to any disclaimer, the term of this patent is extended or adjusted under 35 U.S.C. 154(b) by 509 days.

(21) Appl. No.: 10/937,022

(22) Filed: Sep. 9, 2004

(65) Prior Publication Data

US 2006/0048799 A1 Mar. 9, 2006

(51) Int. Cl.
*B08B 3/02* (2006.01)

(52) U.S. Cl. ..... 134/135; 134/200

(58) Field of Classification Search ..... 134/135, 134/200; 211/41.3
See application file for complete search history.

(56) References Cited

U.S. PATENT DOCUMENTS

| | | | | | |
|---|---|---|---|---|---|
| 1,628,818 | A | * | 5/1927 | Zademach | 134/176 |
| 1,692,190 | A | * | 11/1928 | Templeton | 134/79 |
| 2,104,938 | A | * | 1/1938 | Webb | 134/172 |
| 2,608,981 | A | * | 9/1952 | Jackson | 134/102.1 |
| 2,687,203 | A | * | 8/1954 | Ladewig | 198/446 |
| 2,937,063 | A | * | 5/1960 | Kahn | 312/229 |
| 2,947,311 | A | | 8/1960 | Fox et al. | |
| 3,010,461 | A | * | 11/1961 | Faust et al. | 134/191 |
| 3,099,585 | A | * | 7/1963 | Kahn | 134/6 |
| 3,139,095 | A | * | 6/1964 | Haas | 134/99.1 |
| 3,310,150 | A | * | 3/1967 | Southard | 134/76 |
| 3,413,987 | A | * | 12/1968 | Brown | 134/46 |
| 3,443,852 | A | * | 5/1969 | Janiszewski et al. | 312/350 |
| 3,465,763 | A | * | 9/1969 | Hoffman | 134/154 |
| 4,744,379 | A | * | 5/1988 | Goettel | 134/109 |
| 4,821,755 | A | * | 4/1989 | Hen et al. | 134/72 |
| 5,259,889 | A | * | 11/1993 | Payzant | 134/15 |
| 5,329,952 | A | * | 7/1994 | Kojima et al. | 134/133 |
| 5,570,597 | A | * | 11/1996 | Bongini et al. | 68/17 R |
| 5,622,196 | A | * | 4/1997 | Luongo | 134/72 |
| 5,904,162 | A | * | 5/1999 | Ferguson et al. | 134/25.2 |
| 6,267,124 | B1 | * | 7/2001 | Bowden | 134/71 |
| 6,571,812 | B1 | * | 6/2003 | Lavoie et al. | 134/191 |
| 6,959,714 | B1 | * | 11/2005 | Håkansson et al. | 134/25.2 |
| 2005/0214159 | A1 | * | 9/2005 | Schwei et al. | 422/28 |

FOREIGN PATENT DOCUMENTS

| | | | | |
|---|---|---|---|---|
| DE | 1909093 | U | | 1/1965 |
| DE | 1910159 | U | | 2/1965 |
| DE | 1945679 | U | | 9/1966 |
| DE | 1628730 | A1 | | 8/1971 |
| DE | 2606778 | B1 | | 6/1977 |
| DE | 19513994 | A1 | | 10/1996 |
| EP | 0432281 | A1 | | 6/1991 |
| JP | 05076473 | A | | 3/1993 |
| JP | 8-66347 | | * | 3/1996 |

* cited by examiner

*Primary Examiner*—Frankie L. Stinson
(74) *Attorney, Agent, or Firm*—Thompson Hine LLP

(57) ABSTRACT

A warewash machine includes a housing at least in part defining a washing chamber having an access opening and a door mounted for movement between a closed position for washing and an open position for inlet/outlet of wares through the access opening. At least one nozzle is included for emitting liquid into the washing chamber. A table is connected to the machine for movement between a load/unload position and a storage position.

25 Claims, 8 Drawing Sheets

WAREWASH MACHINE WITH MOVEABLE TABLE AND MULTI-POSITION RACK SUPPORT TRACK

TECHNICAL FIELD

The present application relates to machines for washing wares, and more particularly to a warewash machine that includes a movable table and/or a multi-position rack support track.

BACKGROUND

Warewash machines are frequently used by industries, such as restaurants, for washing relatively large and high numbers of wares. Often, the wares, are placed in a rack for ease of handling and to maintain separation between the wares during washing. With the rack full of wares, the rack can be heavy. Often times warewash machines are located adjacent to separate tables that can temporarily hold racks prior to loading and after unloading from a machine. However, in some environments limited space does not permit placement of a table adjacent the warewash machine. It would be desirable to provide a warewash machine that includes its own movable table for use in such limited space environments.

Some warewash machines have front and side access openings to the washing chamber so that the wares do not have to be removed from the washing chamber through the same access opening through which they were placed into the washing chamber. Certain machines can be configured for either side opening to side opening type loading and unloading (i.e., a through configuration) or front opening to side opening type loading and unloading (i.e., a corner configuration). It would be desirable to easily facilitate both such configurations.

SUMMARY

In an aspect, a warewash machine includes a housing at least in part defining a washing chamber having an access opening and a door mounted for movement between a closed position for washing and an open position for inlet/outlet of wares through the access opening. At least one nozzle is included for emitting liquid into the washing chamber. A table is pivotably mounted to the machine for movement between a load/unload position in which the table extends outwardly from the housing in a rack supporting orientation at a height corresponding to a lower edge of the access opening, and a storage position in which the table is retracted from the load/unload position.

In another aspect, a warewash machine includes a housing at least in part defining a washing chamber having an access opening and a door mounted for movement between a closed position for washing and an open position for inlet/outlet of wares through the access opening. At least one nozzle is included for emitting liquid into the washing chamber. A table is connected to the machine for movement from a load/unload position in which the table extends outwardly from the housing in a rack supporting orientation at a height corresponding to a lower edge of the access opening and a storage position in which the table is retracted from the load/unload position.

In another aspect, a warewash machine has a corner track and through track configuration. The warewash machine includes a housing at least in part defining a washing chamber having a front access opening and first and second side access openings and a rack support track positionable in first and second orientations within the washing chamber for having a dish rack rest thereon during washing. The rack support track includes a substantially horizontal portion for vertically supporting a dish rack and an upright guide portion connected to and extending up from a side of the substantially horizontal portion, the upright guide portion is configured to guide and position a side of a dish rack. When the rack support track is positioned in the first orientation, the upright guide portion extends along the first side access opening to provide a corner track machine configuration in which dish racks are loaded and unloaded through the front access opening and the second side access opening. When the rack support track is positioned in the second orientation, the rack support track is rotated ninety degrees relative to its position when in the first orientation such that the upright guide portion extends along the front access opening to provide a through track configuration in which dish racks are loaded and unloaded through the first side access opening and the second side access opening.

The details of one or more embodiments are set forth in the accompanying drawings and the description below. Other features, objects, and advantages will be apparent from the description and drawings, and from the claims.

DETAILED DESCRIPTION

Figure 1:
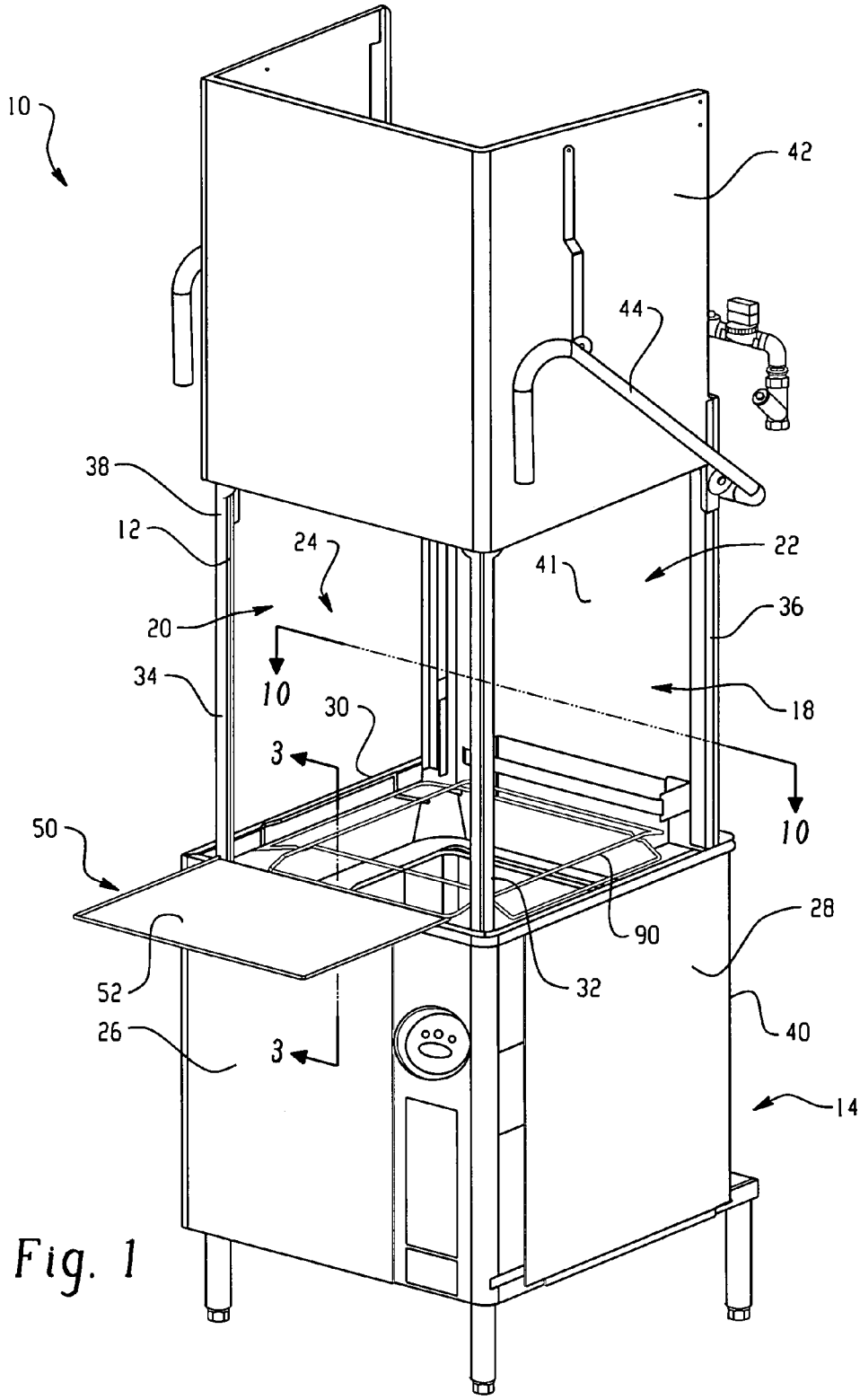
FIG. 1 is a perspective view of an embodiment of a warewash machine.
Figure 5:
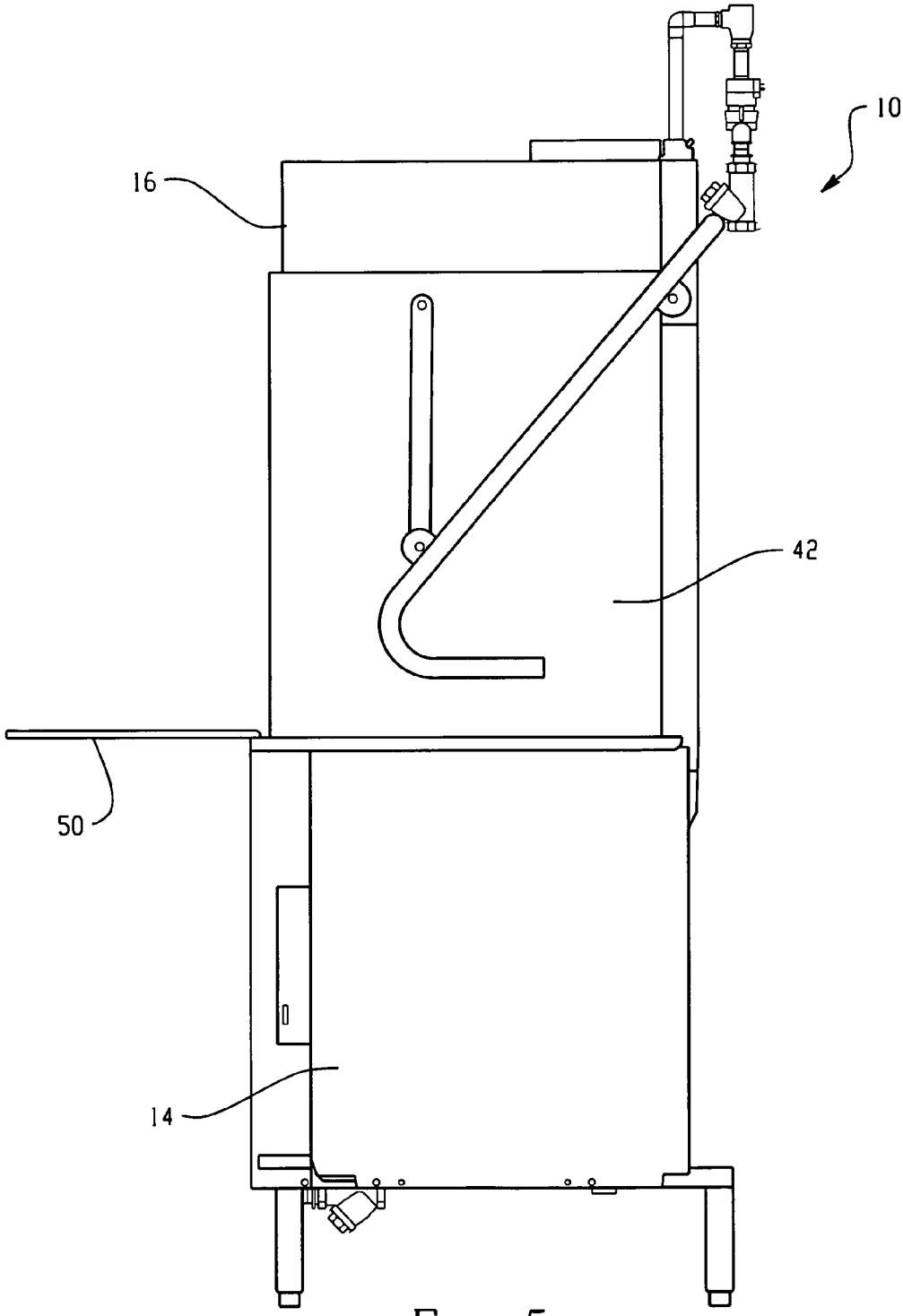
FIG. 5 is a side view of the warewash machine of FIG. 1 with door closed and table in the load/unload position.

Referring to FIG. 1, a warewash machine 10 includes a frame 12, a lower housing 14, an upper housing 16 (FIG. 5) spaced from the lower housing and a washing chamber 18 located between the upper and lower housings. For the placement and removal of wares into and out of the washing chamber 18, a set of access openings 20, 22, 24 are provided. The access openings 20, 22, 24 are disposed at the front 26 and sides 28, 30, respectively, of the warewash machine 10 and are each formed between the upper and lower housings 14, 16 and associated frame members 32, 34, 36, 38. At a rear side 40 of the warewash machine 10, a rear housing panel 41 is fixedly attached to the warewash machine, e.g., to inhibit access to the washing chamber 18 from the rear side 40. To control access to the washing chamber 18 from the front 26 and sides 28, 30, a three-sided door 42 is provided that can slide between closed and open positions using arm 44.

Extending outwardly at the front 26 of the warewash machine 10 is a table 50. Table 50 is pivotably mounted to the warewash machine 10 and is shown in a load/unload position with a broad, planar upper surface 52 extending outwardly from the front 26 of the warewash machine in a rack supporting orientation in which a rack will be supported vertically above the floor. In the illustrated embodiment the table is angled slightly from the horizontal to as to extend slightly upward in a direction moving from the access opening to the opposite end of the table. This angled orientation allows liquid that is deposited on the table to flow back toward the access opening and into the machine. In another example, the table may be substantially horizontal. As will be described in greater detail below, the table 50 can be pivoted from its load/unload position (e.g., for supporting a rack of wares) to a vertical storage position (e.g., for cleaning the table during a routine ware washing operation).

Figure 2:
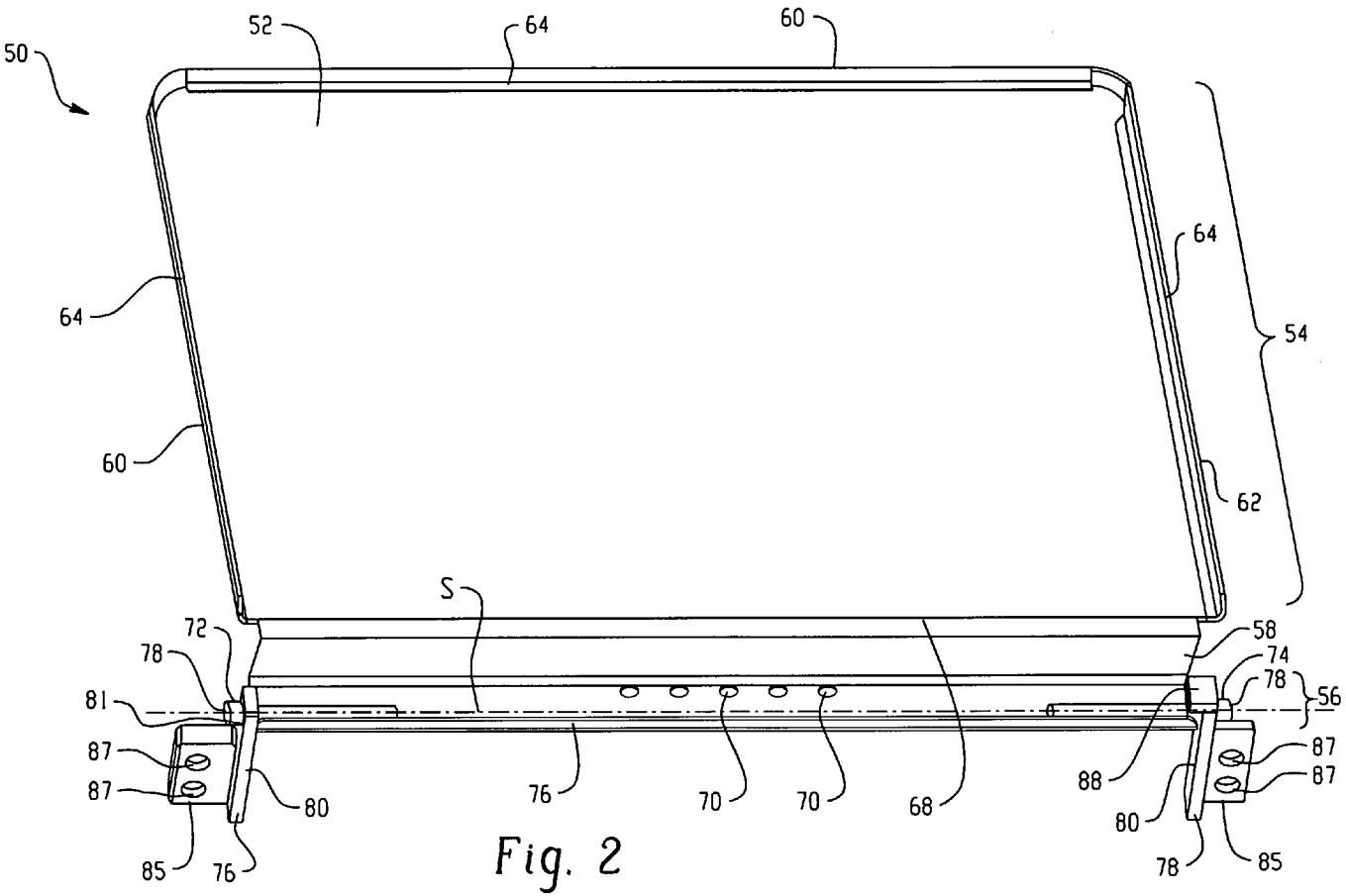
FIG. 2 is a perspective view of a table of FIG. 1.

Referring now to FIG. 2, table 50 includes a substantially planar first portion 54 and a relatively short, substantially planar second portion 56. The first portion 54 is offset from the second portion 56 by a bend 58 formed between the first and second portions of the table 50. The bend 58 extends between side edge 60 and opposite side edge 62 and substantially parallel to axis S. Extending about a periphery of the first portion 54 of the table 50 is an upwardly extending lip 64. The lip 64 extends upwardly from the upper planar surface 52 of the table and along the sides 60, 62 and end 66. Disposed at second portion 56 are openings 70 that can allow water drainage, e.g., when the table 50 is in the load/unload position.

Located at opposite sides at the second portion 56 are projections 72 and 74, respectively. The projections 72, 74 have an end 78 that extends outwardly beyond the sides and are positioned adjacent bend 76 such that the long axis of each of the projections are aligned with axis S. As shown, the projections 72, 74 are cylindrical, however, any other suitable shape can be used.

To connect the table 50 to the machine 10, pivot mounts 76 and 78 includes an aperture 81 extending through a wall 80 that is sized to receive a respective projection 72, 74. Alternatively, in some embodiments, projections 72 and 74 include an aperture sized to receive a pin extending from the pivot mounts 76, 78. Other hinge configurations are possible. The pivot mounts 76, 78 and table 50 can be mounted to the machine 10 within the washing chamber 18 via the mount brackets 85 that include mount holes 87 for receiving mount fasteners (not shown). The table could be mounted to the machine during initial manufacture, or could be provided as a stand-alone piece for installation on machines at customer sites as a retrofit or upgrade part.

In some embodiments, the first portion 54, second portion 56, bends 58, 76 and lip 64 are ail formed from a single sheet of material, such as a metal sheet (e.g., of stainless steel). In the illustrated embodiment the projections 72, 74 are formed separately as cylindrical members and then attached to the mount end of the table 50 (e.g., by welding). As an alternative, the projections could be unitary with the rest of the table (e.g., projections formed from the metal sheet itself. Other table configurations are contemplated, such as a table formed of a wire weldment or plastic mesh. Upper surface 52, in some cases, may include a texture (not shown) for increasing surface friction of the upper surface, and/or a friction-increasing article, such as a rubber or plastic pad, may be disposed or affixed to the upper surface.

Figure 3:
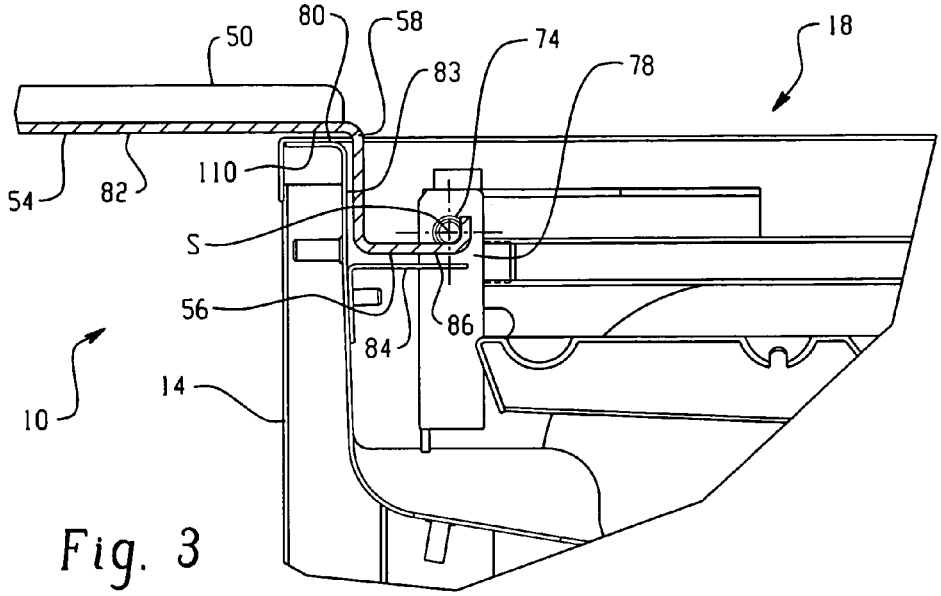
FIG. 3 is a section view along line 3-3 of FIG. 1.
Figure 4:
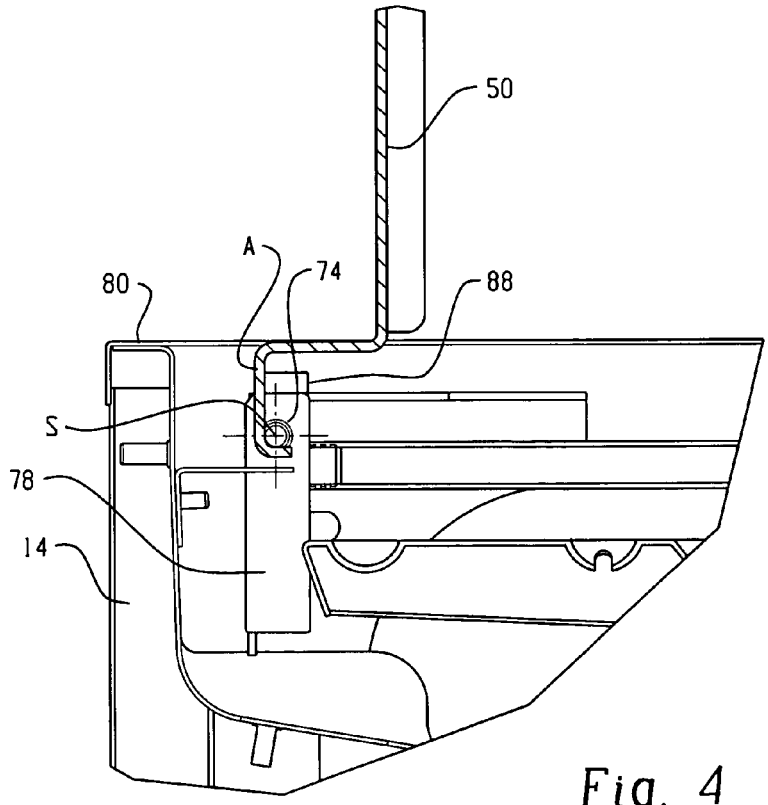
FIG. 4 is a section view along line 3-3 of FIG. 1 with the table in the storage position.

Referring now to FIGS. 3 and 4, section views show table 50 mounted to machine 10 in each of the load/unload and storage positions, respectively. Projection 74 forms a portion of a hinge connection between the table 50 and stationary pivot mount 78. The hinge connection forms pivot axis S that is positioned within the washing chamber 18 and extends substantially parallel to and below upper edge 80 of lower housing 14. Referring now to FIG. 3, in the load/unload position, the table 50 extends from within the washing chamber 18 and through the access opening. Bend 58 has a contour corresponding to the upper edge 80 and inner side 83 of the lower housing 14 and the table 50 is shaped to allow the door 42 to fully close, e.g., to perform a washing operation while the table is in the load/unload position (see FIG. 5). The door 42, while in the closed position, limits movement of the table 50 toward the storage position.

While in the load/unload position, the upper edge 80 of the lower housing 14 serves as support structure for the table 50 to maintain the table in a relatively horizontal orientation. The upper edge 80 contacts a lower surface 82 of the table 50 at the inward side of the first portion 54 and supports the table at a location 110 spaced horizontally from the pivot axis S. An L-shaped bracket 84 (FIG. 3) is also shown and is provided to act as a water deflector when the table is in the storage position.

Referring to FIG. 4, table 50 is shown in the storage position. In the storage position, the table 50 is pivoted upward and rests against a stop 88 (e.g., a metal bar welded to one or both of the pivot mounts; see also FIG. 2). When in the storage position, the shape of the table 50 is such that the table's center of gravity is located inward of the pivot axis S in order to help maintain the table 50 in the vertical, storage position by biasing the table 50 against the stop 88.

Figure 7:
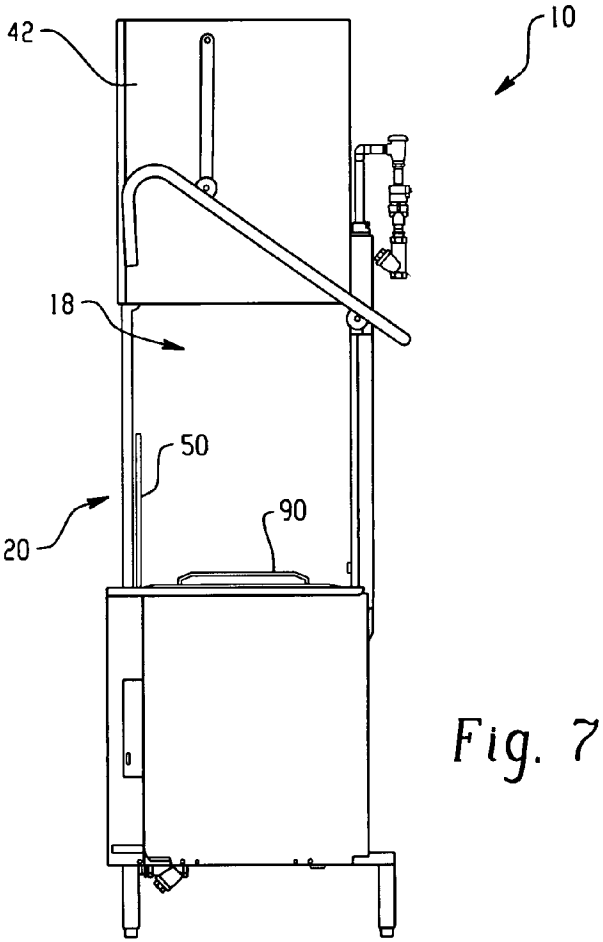
FIGS. 6 and 7 are side views of the warewash machine of FIG. 1 with the table in the storage position and the door in the closed and open position, respectively.
Figure 6:
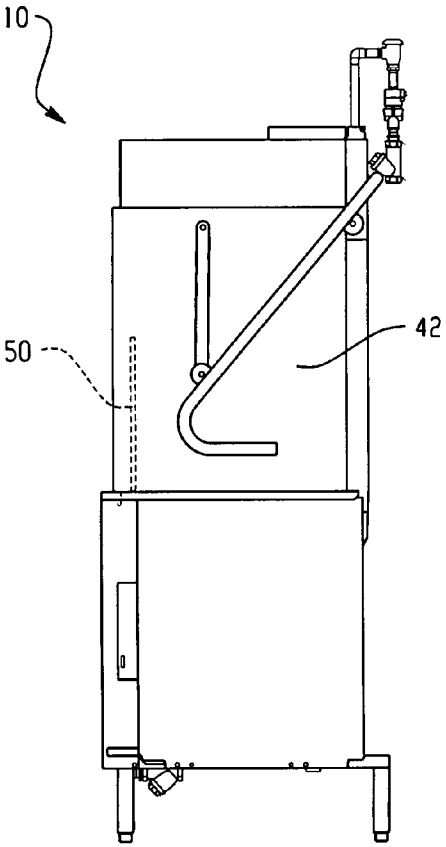

Referring now to FIGS. 6 and 7, when in the storage position, the table 50 is positioned within the washing chamber 18 and spaced from the access opening 20. While in this position, the door 42 can be closed and, for example, a washing operation can be performed with the table 50 disposed within the washing chamber 18. This can provide a convenient way to wash the table 50, e.g., while washing wares.

Figure 8:
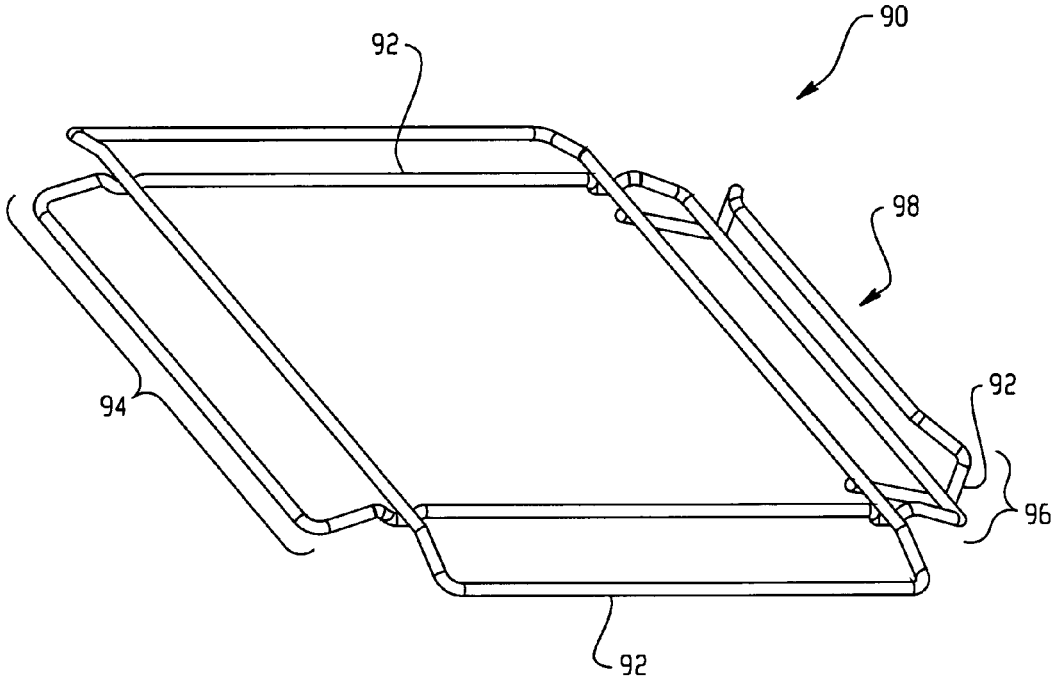
FIG. 8 is a perspective of an embodiment of a rack support track.

Referring back to FIG. 1, to aid in locating a rack within the washing chamber 18, a rack support track 90 is included. Referring to FIG. 8, the rack support track 90 is a wire form weldment of multiple wires 92 (e.g., 5/16 inch stainless steel rods that are bent and that are spot or TIG welded together to provide a rigid track structure). In some embodiments, the rack support track 90 can be formed of a single piece of material. The rack support track 90 includes a horizontal portion 94 and a vertical portion 96 extending upwardly along a side edge 98 of the horizontal portion forming an L-shaped track portion for guiding a rack as it is slid across the horizontal portion 94. The remaining three sides of the rack support track have like configurations so that any one of such sides can engage the chamber hooks 106 described below.

Figure 9:
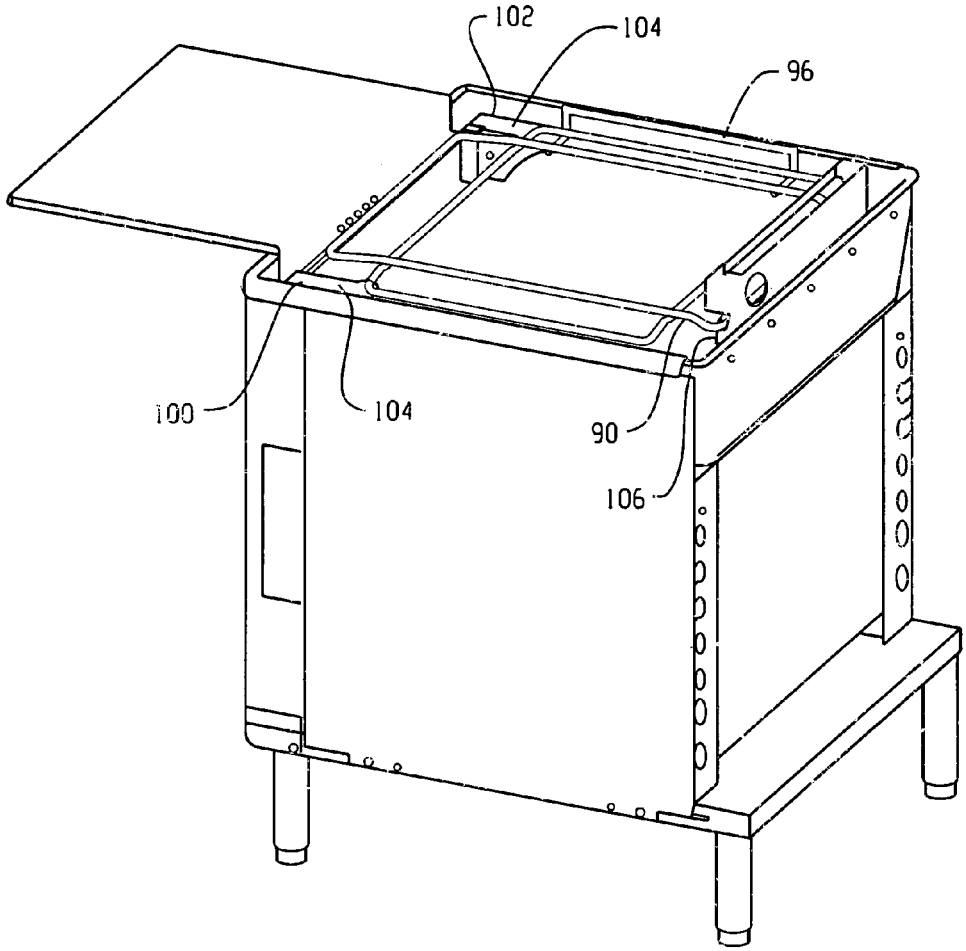
FIG. 9 is a perspective view of a portion of the warewash machine of FIG. 1 including the rack support track of FIG. 8.

Referring to FIG. 9, the rack support track 90 is supported within the washing chamber by support structure located at the front and rear of the washing chamber. As shown, the rack support track 90 is supported at the front of the washing chamber by a pair of tank chamber mounts 100 and 102, each having an upper surface 104 against which the rack support track can rest. The rack support track 90 is supported along the rear of the washing chamber by hooks 106. The rack support track 90, although supported by the support structure, e.g., to allow a rack of wares to be supported thereon, is unrestricted for movement in a direction such that the rack support track 90 can be moved manually.

Figure 10:
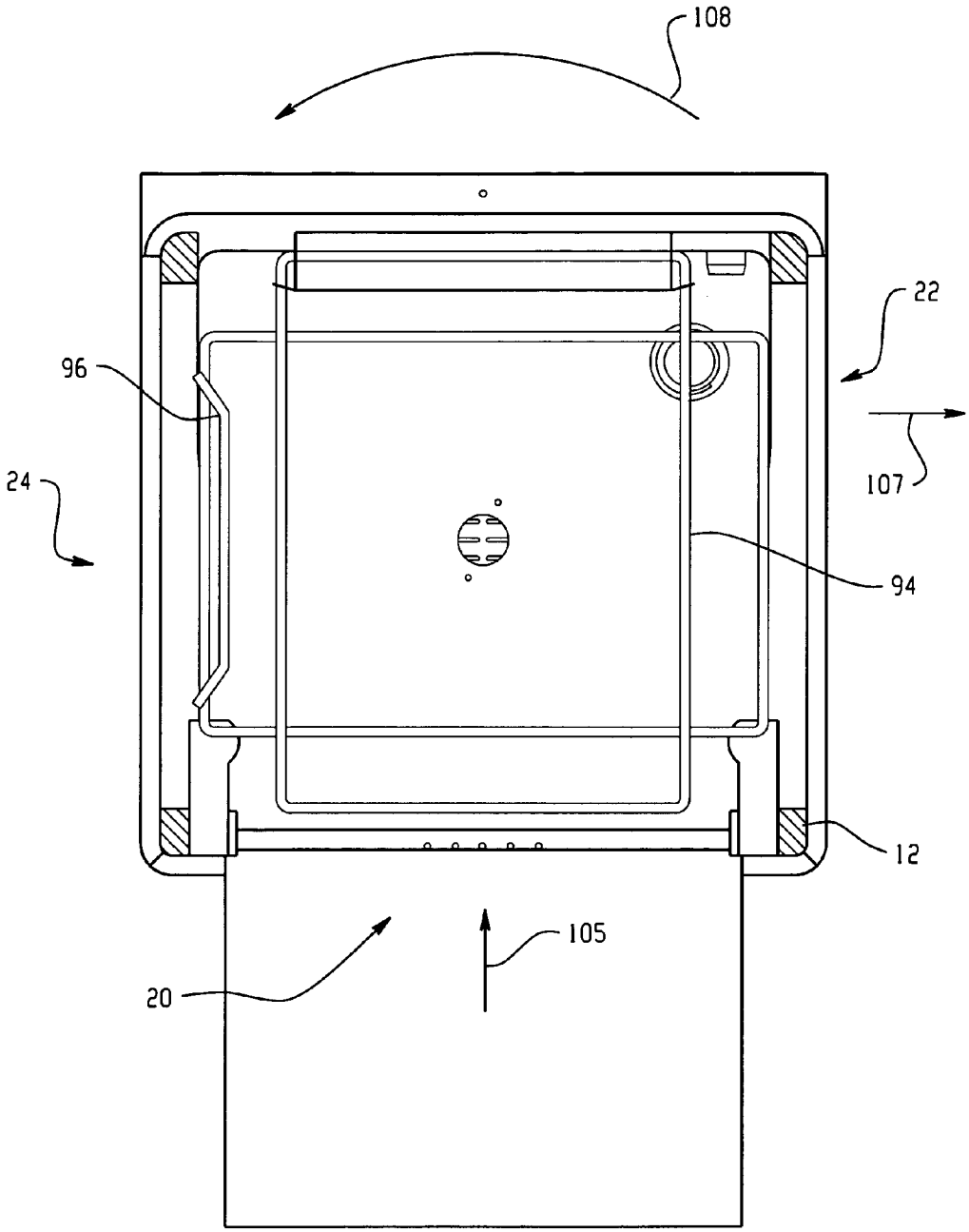
FIG. 10 is a section view of the warewash machine of FIG. 1 along line 10-10.

Referring now to FIG. 10, the vertical portion 96 is shown located adjacent side access opening 24 forming a corner track configuration. That is, the vertical portion allows a rack to slide along the horizontal portion 94 through the front access opening 20, e.g., in the direction of arrow 105, and through side access opening 22, e.g., in the direction of arrow 107, but inhibits a rack from sliding along the horizontal portion through side access opening 24. By reorienting the rack support track 90 (e.g., manually) to position the vertical portion 96 adjacent the front access opening 20, for example by rotating the rack support track 90 degrees in the direction of arrow 108, a through track configuration can be provided. That is, the vertical portion 96 allows a rack to slide along the horizontal portion through the side access openings 22 and 24, but inhibits a rack from sliding along the horizontal portion 94 through the front access opening 20. In the illustrated embodiment the rack support track can be reoriented (e.g, rotated) without use of tools or additional fasteners such as screws or bolts.

A number of detailed embodiments have been described. Nevertheless, it will be understood that various modifications may be made. For example, the table could be mounted to pivot downward from the load/unload position so that in the storage position the table lies against the front surface of the lower housing. Further, while a pivoting table has been shown in the illustrated embodiment, a sliding drawer type table arrangement could be provided. Accordingly, other embodiments are within the scope of the following claims.

What is claimed is:

1. A warewash machine comprising:

a housing at least in part defining a washing chamber having an access opening;

a door mounted for movement between a closed position for washing and an open position for inlet/outlet of wares through the access opening, the door maintaining an upright orientation in both the closed position and the open position;

at least one nozzle for emitting liquid into the washing chamber; and a table pivotably mounted to the machine for movement between a load/unload position and a storage position, in the load/unload position the table extends outward from the housing in a rack supporting orientation at a height corresponding to a lower edge of the access opening, in the storage position the table is retracted from the load/unload position, wherein in the storage position the table is within the washing chamber and inward of the door enabling the table to be cleaned by a washing operation of the machine.

2. The warewash machine of claim 1, wherein a mount end of the table is within the washing chamber.

3. The warewash machine of claim 2, wherein the mount end of the table has a pivot axis that is substantially parallel to the lower edge of the access opening.

4. The warewash machine of claim 2, wherein the mount end of the table includes a bend extending between opposite side edges of the table and substantially parallel to the pivot axis.

5. The warewash machine of claim 1, wherein in the load/unload position a free end of the table faces outward away from the housing and in the storage position a free end of the table faces upward.

6. The warewash machine of claim 1, wherein in the load/unload position the table is angled slightly relative to horizontal to cause liquid on the table to flow toward the access opening.

7. The warewash machine of claim 1, wherein the table is movable separately from the door and in a pivoting manner, and the door slides vertically upward and downward for movement between the open and closed positions.

8. The warewash machine of claim 1, wherein in the load/unload position, the table extends from within the washing chamber and through the access opening and the table is supported at its inward end such that an area beneath the table is free of obstructions.

9. The warewash machine of claim 8, wherein in the load/unload position, the table being configured such that the door can be placed in the closed position.

10. The warewash machine of claim 1, wherein the housing includes a lower housing that defines the lower edge of the access opening, wherein in the load/unload position the lower housing supports the table at a location spaced from a pivot axis of the table.

11. The warewash machine of claim 1, wherein the table comprises a unitary metal sheet extending from a mount end of the table to a free end of the table.

12. The warewash machine of claim 1 wherein the table includes upwardly extending lips on at least three sides thereof.

13. The warewash machine of claim 1, wherein a mount end of the table includes a pair of projections extending outwardly at opposite sides of the table, each projection received by a corresponding pivot mount that is mounted to the machine.

14. The warewash machine of claim 13, wherein each pivot mount includes an opening extending inwardly from a side surface of the respective pivot mount, the openings being shaped to receive the respective projections to allow the projections to rotate within the openings with respect to the pivot mounts as the table is rotated between the load/unload and storage positions.

15. The warewash machine of claim 1, wherein when the door is in its closed position the door prevents the table from moving from the load/unload position to the storage position.

16. A warewash machine comprising:

a housing at least in part defining a washing chamber having an access opening;

a door mounted for movement between a closed position for washing and an open position for inlet/outlet of wares through the access opening;

at least one nozzle for emitting liquid into the washing chamber; and a table pivotably mounted to the machine for movement between a load/unload position and a storage position, in the load/unload position the table extends outward from the housing in a rack supporting orientation at a height corresponding to a lower edge of the access opening, in the storage position the table is retracted from the load/unload position, wherein the table has a first planar portion and a second planar portion, when in the load/unload position the first planar portion being offset vertically lower than the second planar portion such that the second planar portion is disposed below the lower edge of the access opening.

17. A warewash machine comprising:

a housing at least in part defining a washing chamber having an access opening;

a door mounted for movement between a closed position for washing and an open position for inlet/outlet of wares through the access opening;

at least one nozzle for emitting liquid into the washing chamber; and a table connected to the machine for movement from a load/unload position and a storage position, in the load/unload position the table extends outwardly from the housing in a rack supporting orientation at a height corresponding to a lower edge of the access opening, in the storage position the table is retracted from the load/unload position, wherein the table is pivotally connected to the machine for pivotal movement separately from the door, a mount end of the table is positioned within the housing, in the load/unload position the table is angled slightly relative to horizontal to cause liquid on the table to flow toward the access opening, in the storage position a free end of the table faces upward.

18. The warewash machine of claim 17, wherein the table is connected to the machine at a location within the washing chamber.

19. The warewash machine of claim 17, wherein the table includes a bend extending between opposite side edges of the table, the bend having a contour that substantially corresponds to a contour of the lower edge of the access opening.

20. The warewash machine of claim 17, wherein in the storage position the table is within the washing chamber enabling the table to be cleaned by a washing operation of the machine.

21. The warewash machine of claim 20, wherein when the door is in its closed position the door prevents the table from moving from the load/unload position to the storage position.

22. The warewash machine of claim 17, wherein in the storage position the table is in a substantially vertical position.

23. The warewash machine of claim 17, wherein the table is supported at its inward end such that an area beneath the table is free of obstructions.

24. The warewash machine of claim 17 further comprising a rack support track positionable in first and second orientations within the washing chamber for having a dish rack rest thereon during washing, the rack support track including a substantially horizontal portion for vertically supporting a dish rack and an upright guide portion connected to and extending up from a side of the substantially horizontal portion, the upright guide portion configured to guide and position a side of a dish rack.

25. The warewash machine of claim 17, wherein a mount end of the table includes a pair of projections extending outwardly at opposite sides of the table, each projection received by a corresponding pivot mount that is mounted to the machine, and each pivot mount includes an opening extending inwardly from a side surface of the respective pivot mount, the openings being shaped to receive the respective projections to allow the projections to rotate within the openings with respect to the pivot mounts as the table is rotated between the load/unload and storage positions.

* * * * *